US011203516B2

(12) United States Patent
Porter

(10) Patent No.: US 11,203,516 B2
(45) Date of Patent: Dec. 21, 2021

(54) ENHANCED TANKLESS EVAPORATOR

(71) Applicant: Haws Corporation, Sparks, NV (US)

(72) Inventor: Dean Porter, Reno, NV (US)

(73) Assignee: Haws Corporation, Sparks, NV (US)

( * ) Notice: Subject to any disclaimer, the term of this patent is extended or adjusted under 35 U.S.C. 154(b) by 51 days.

(21) Appl. No.: 16/749,121

(22) Filed: Jan. 22, 2020

(65) Prior Publication Data

US 2020/0231425 A1 Jul. 23, 2020

Related U.S. Application Data

(60) Provisional application No. 62/795,653, filed on Jan. 23, 2019.

(51) Int. Cl.
*B67D 1/08* (2006.01)

(52) U.S. Cl.
CPC ..... *B67D 1/0861* (2013.01)

(58) Field of Classification Search
CPC ..... B67D 1/0861; F25B 39/02; F25D 31/002
See application file for complete search history.

(56) References Cited

U.S. PATENT DOCUMENTS 985,757 A 2/1911 Haws
1,945,103 A * 1/1934 Vis ..... F25B 39/02 62/227
2,267,819 A 5/1938 Di Pietro
2,464,667 A 7/1946 Boosman et al.
3,877,128 A * 4/1975 Tibbetts ..... F25B 39/02 29/890.046
4,061,184 A 12/1977 Radcliffe
4,286,653 A 9/1981 Edwards
5,474,717 A 12/1995 Bucher et al.
6,434,967 B2 8/2002 Emerick, Sr. et al.
2005/0160759 A1 7/2005 Chaney et al.
2005/0279488 A1* 12/2005 Stillman ..... F28D 1/0478 165/177
2010/0269534 A1* 10/2010 Kumakiri ..... F25C 1/10 62/346
2012/0096888 A1 4/2012 Park et al.
2012/0267073 A1 10/2012 Yoon
2015/0027159 A1 1/2015 Kuehl et al.
2016/0061515 A1* 3/2016 Wiemer ..... B67D 1/0063 165/135
2019/0178591 A1* 6/2019 Shiomi ..... F28F 1/32
2020/0080755 A1* 3/2020 Jung ..... B67D 1/00
2020/0102527 A1* 4/2020 Hong ..... B65D 85/72

FOREIGN PATENT DOCUMENTS

DE 3415401 A1 * 10/1985 ..... B67D 1/04
GB 2483073 A * 2/2012 ..... B67D 1/0057
JP 2015-508150 A 3/2015

* cited by examiner

*Primary Examiner* — Donnell A Long
(74) *Attorney, Agent, or Firm* — Cesari and McKenna, LLP

(57) ABSTRACT

Tankless evaporators, refrigeration circuits, and water coolers use a drum as a thermal mass without using one or more tanks for storing water. Water coolers can include a tankless evaporator. Also described are refrigeration circuits suitable for a water cooler and which include a tankless evaporator. An evaporator for use in a fluid chiller includes a drum of heat conductive material defining a thermal mass, a water coil disposed adjacent around the drum, an evaporator coil configured around the drum and adjacent to the water coil, in which the evaporator coil is operative to cool the water coil.

10 Claims, 5 Drawing Sheets

ENHANCED TANKLESS EVAPORATOR

CROSS-REFERENCE TO RELATED APPLICATIONS

This application is based upon and claims priority to U.S. provisional patent application 62/795,653, entitled "Enhanced Tankless Evaporator," filed 23 Jan. 2019; the entire content of the noted application is incorporated herein by reference.

BACKGROUND

Technical Field

This disclosure relates generally to refrigeration, and more particularly to water chillers or water coolers.

Description of Related Art

The need for cold potable water led to the development of the water cooler—also called water dispenser, water chiller, or water fountain—a device that cools and dispenses water. The first watercooler was invented in 1906 by two men, Halsey Willard Taylor and Luther Haws. Mr. Haws formed the Haws Sanitary Drinking Faucet company in 1909, and thereafter obtained a patent on the first "sanitary drinking faucet" in 1911. See U.S. Pat. No. 985,757. Mr. Haws' patented design was used to dispense chilled and purified water, avoiding problems with bacterial growth such as typhoid fever. In initial designs, water coolers used large blocks of ice to chill water. In 1938, Mr. Haws introduced the first electrical self-contained water cooler. The Haws Corporation later introduced the "Barrier free" electric water cooler in 1972, which was a wall mounted device without a base unit that allowed users to freely access the underside of the faucet device. Similar water coolers are now commonplace around the globe.

Water coolers are generally divided into two design types: bottle-less water coolers and bottled water coolers. Both bottled water coolers and bottle-less water coolers provide a chilled water supply, but each type of design receives water from a different source. Bottled water coolers, typically freestanding units, use a relatively large (typically plastic) bottle to deliver water, and can be either bottom-loaded or top-loaded. Bottle-less water coolers on the other hand are typically connected to a mains water supply. Typical modern water coolers, often referred to as electric water coolers ("EWCs"), employ a design having a refrigeration unit to enable dispensing of cold water. As shown in FIGS. 1A-1B, such EWCs are commonly free-standing or wall-mounted.

FIG. 1A depicts a representative water cooler (EWC) 100A with a free-standing design. The main components of both general design types are shown. The cooler 100A has a casing or housing 110 and a cold-water tank 120 (shown by dashed lines) is located inside the housing 110. FIG. 1B depicts a representative wall-mounted EWC 100B. EWC 100B includes a housing 130 and a cold-water tank 140 (indicated by dashed lines). EWC 100B is configured for mounting to a wall and to receive water from a water main (not shown).

Water cooler designs typically employ refrigeration circuits relying on an evaporator component to evaporate pressurized refrigerant. Such designs are often referred to as "evaporator-based" designs, in reference to the evaporator used to evaporate the refrigerant in the circuit and thereby cool water.

FIG. 2 depicts a diagram of a typical closed refrigeration circuit 200 used for a fluid chiller. Such a circuit 200 can be used, for example, in cooling a volume of water in water cooler applications. As shown in FIG. 2, refrigeration circuit 200 includes a compressor 202, a condenser 204, an expansion device (e.g., a throttling vale, restricting orifice, or capillary tube) 206, and an evaporator 208. In operation, compressor 202 receives input power which causes work to be done on the refrigerant, compressing the refrigerant (which is in the gas phase at the location of the compressor 202). The compression of the refrigerant increases the pressure and temperature of the refrigerant, and causes the refrigerant to move in the circuit 200. While refrigeration circuit 200 is shown as a closed circuit, such a circuit can be open in other embodiments.

At the condenser 204, heat is removed from the refrigerant and transferred to the local environment (e.g., water used for cooling, air, etc.) during condensation of the refrigerant from the gas phase to the liquid phase. This results in heating of that environment (indicated as "Heated Environment"). The refrigerant liquid moves to the expansion device 206, e.g. capillary tube which has a smaller cross-sectional area than the circuit channel upstream of the expansion valve, causing a decrease in the pressure of the refrigerant downstream of the valve and a concomitant decrease in temperature of the refrigerant. The refrigerant subsequently moves to the evaporator 208 where it absorbs heat from the hotter ambient environment, and in doing so, cools that ambient environment (indicated as "Cooled Environment").

Typically, such water coolers rely on a water-holding tank, which is surrounded by a refrigerant line used for the evaporator of the related refrigeration circuit (see FIG. 2) and a separate water line. Such designs commonly present a number of drawbacks or limiting characteristics, including one or more of the following: (1) numerous leak paths; (2) low rate of heat transfer, insufficient for satisfactory performance at a specified flow rate, e.g., 8 GPH according to ASHRAE 18; (3) water volumes being cooled at dissimilar rates; (4) high freezing risk; (5) product use does not completely flush older water out of evaporator (plug flow); (6) significant risk of tank leakage; (7) significant galvanic-corrosion risk in waterway; (8) inability to pass NSF-61, e.g., dues to unacceptably high levels of metals such as chromium and copper; (9) high cost; (10) large size; and (11) single-wall design that is susceptible to risk of cross-communication of refrigerant to waterway.

Prior "tanked" water cooler designs—relying on a water tank for holding and cooling water—can present several problems in operation. For example, they may have a production cost that is relatively high. Further, the use of a tank may result in bacterial growth in the water due to lack of "plug flow." The two different water volumes (presented by the coil and tank, respectively) can cool at dramatically different rates, causing a slow "recharge time" between cooling cycles. This is because the refrigeration system typically must turn off before freezing the water coil, even if the tank hasn't yet reached the temperature set point. Moreover, chromium and copper levels may be an issue, e.g., possibly exceeding levels set by NSF-61.

Some tankless evaporator designs have employed a tankless, small rectangular copper tube-on-tube design. These designs have presented issues meeting characteristics 3 and 5, noted above. Some tanked evaporators have used a copper refrigerant coil wrapped around a stainless steel tank. These designs have had issues meeting characteristics 2, 6, and 7. Some tanked evaporators have used a rectangular copper tube-on-tube design where both a refrigerant and a water tube are wrapped around a stainless steel tank, with the refrigerant coil typically being the inner coil (closest to the tank). These designs have had issues meeting characteristics 1, 4, 5, 6, 7, and sometimes 8, 9, and 10, noted above.

Some tankless evaporators use larger copper tube-on-tube designs (such as the Murdock design), but these have issues with characteristic 11.

SUMMARY

An aspect of the present disclosure is directed to and provides a tankless evaporator for use in a refrigeration circuit.

A further aspect of the present disclosure is directed to and provides a water cooler having a tankless evaporator.

Another aspect of the present disclosure is directed to and provides a refrigeration circuit, e.g., suitable for a water cooler, that includes a tankless evaporator.

An exemplary embodiment includes an evaporator for use in a fluid chiller, the evaporator including: a drum of heat conductive material defining a thermal mass; a water coil disposed adjacent around the drum; an evaporator coil configured around the drum and adjacent to the water coil, wherein the evaporator coil is operative to cool the water coil. For the evaporator, the drum can have a cylindrical body with an inner radius of curvature and an outer radius of curvature, wherein the difference between the outer and inner radii of curvature defines a thickness, and wherein the thickness is between one and thirty times a thickness of the water coil or of the evaporator coil in a direction normal to a longitudinal axis of the cylindrical body. The drum can include or be made of aluminum. The drum can include or be made of an aluminum alloy, for example. Examples of suitable aluminum alloys include, but are not limited to, 6060, 6061, or 6063 aluminum alloy. For the evaporator of, the water coil or evaporator coil can include or be made of copper, or a copper alloy, including but not limited to, C10200, C12000, or C12200 copper alloy; other suitable materials may be used.

A further exemplary embodiment includes a water cooler for dispensing cooled water, the water cooler including: a housing configured to receive water from a water supply; a refrigeration circuit for cooling water supplied by the water supply; wherein the refrigeration circuit includes an evaporator including, (i) a drum of heat conductive material defining a thermal mass; (ii) a water coil disposed adjacent around the drum; and (iii) an evaporator coil configured around the drum and adjacent to the water coil, wherein the evaporator coil is operative to cool the water coil; and a cold-water valve configured to dispense cooled water received from the evaporator. For the water cooler, the drum can have a cylindrical body with an inner radius of curvature and an outer radius of curvature, wherein the difference between the outer and inner radii of curvature defines a thickness, and wherein the thickness is between, e.g., one and thirty times a thickness of the water coil or of the evaporator coil in a direction normal to a longitudinal axis of the cylindrical body. The water cooler can include a heating element and hot-water valve configured to dispense hot water. The water cooler can include a refrigeration circuit configured to supply the evaporator with refrigerant. The water cooler can include a controller, e.g., an electrical circuit with a CPU or other processor, operative to control operation of the refrigeration circuit, e.g., to turn the compressor on and off at desired times or under certain conditions for cooling.

Another exemplary embodiment includes a refrigeration circuit for cooling a fluid, the circuit including: a compressor operative to compress a refrigerant in a conduit; a condenser; a throttling device and an evaporator, wherein the evaporator includes, (i) a drum of heat conductive material defining a thermal mass; (ii) a water coil disposed adjacent around the drum; and (iii) an evaporator coil configured around the drum and adjacent to the water coil, wherein the evaporator coil is operative to cool the water coil; and wherein the drum has a cylindrical body with an inner radius of curvature and an outer radius of curvature, wherein the difference between the outer and inner radii of curvature defines a thickness, and wherein the thickness is between, e.g., one and thirty times a thickness of the water coil or of the evaporator coil in a direction normal to a longitudinal axis of the cylindrical body.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without various of the components or steps that are illustrated. When the same numeral appears in different drawings, it refers to the same or like components or steps.

DETAILED DESCRIPTION OF ILLUSTRATIVE EMBODIMENTS

Illustrative embodiments are now described. Other embodiments may be used in addition or instead. Details that may be apparent or unnecessary may be omitted to save space or for a more effective presentation. Some embodiments may be practiced with additional components or steps and/or without various of the components or steps that are described.

An aspect of the present disclosure is directed to and provides a tankless evaporator for use in a refrigeration circuit. Exemplary embodiments of the present disclosure include water coolers having a tankless evaporator.

Figure 1B:
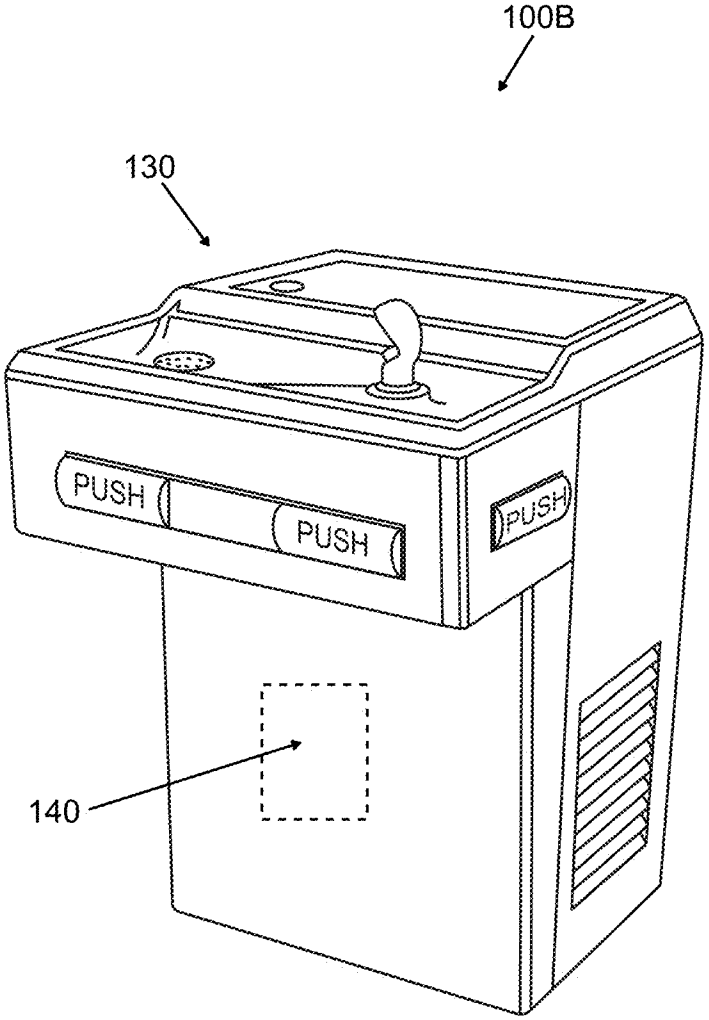
FIG. 1B (PRIOR ART)
FIG. 1B depicts a representative prior art wall-mounted electric water cooler.
Figure 1A:
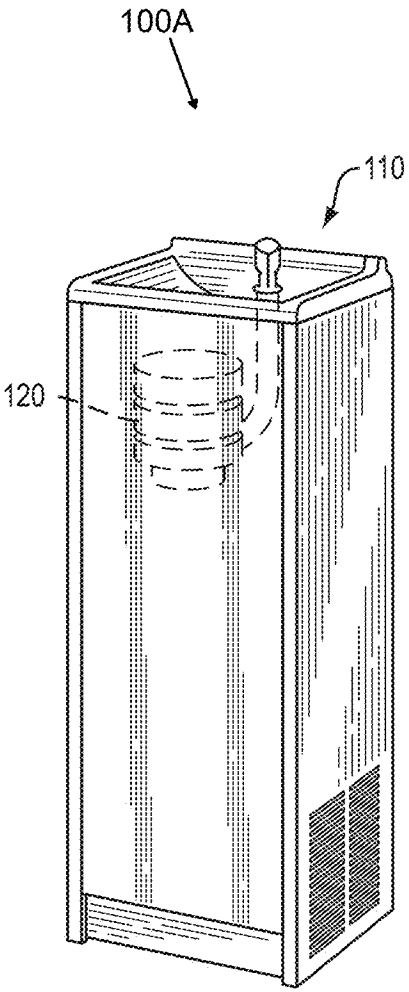
FIG. 1A (PRIOR ART)
FIG. 1A depicts a representative prior art floor-mounted electric water cooler design.
Figure 2:
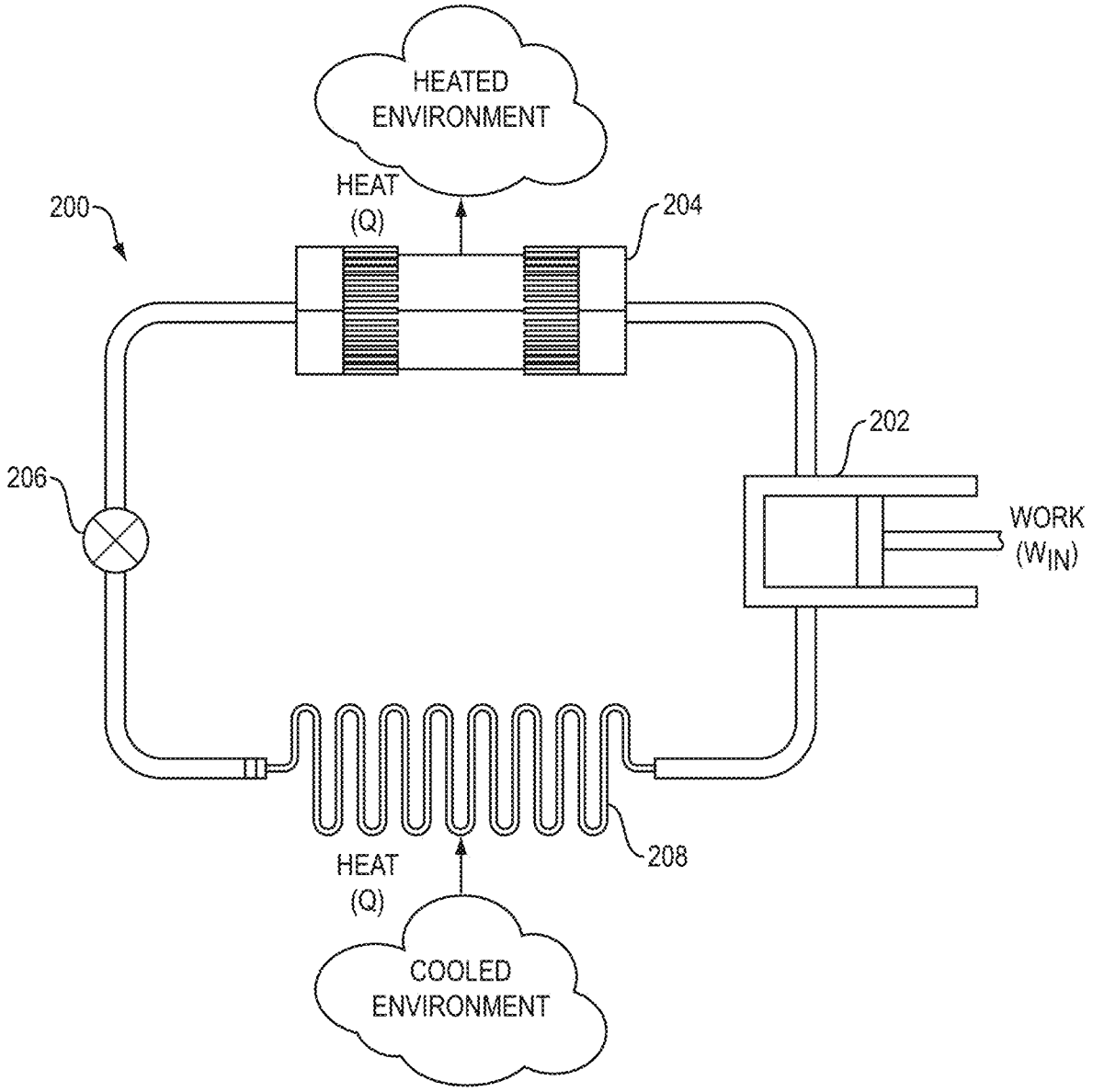
FIG. 2 depicts a diagram of a typical refrigeration closed circuit used in water cooler applications.
Figure 3:
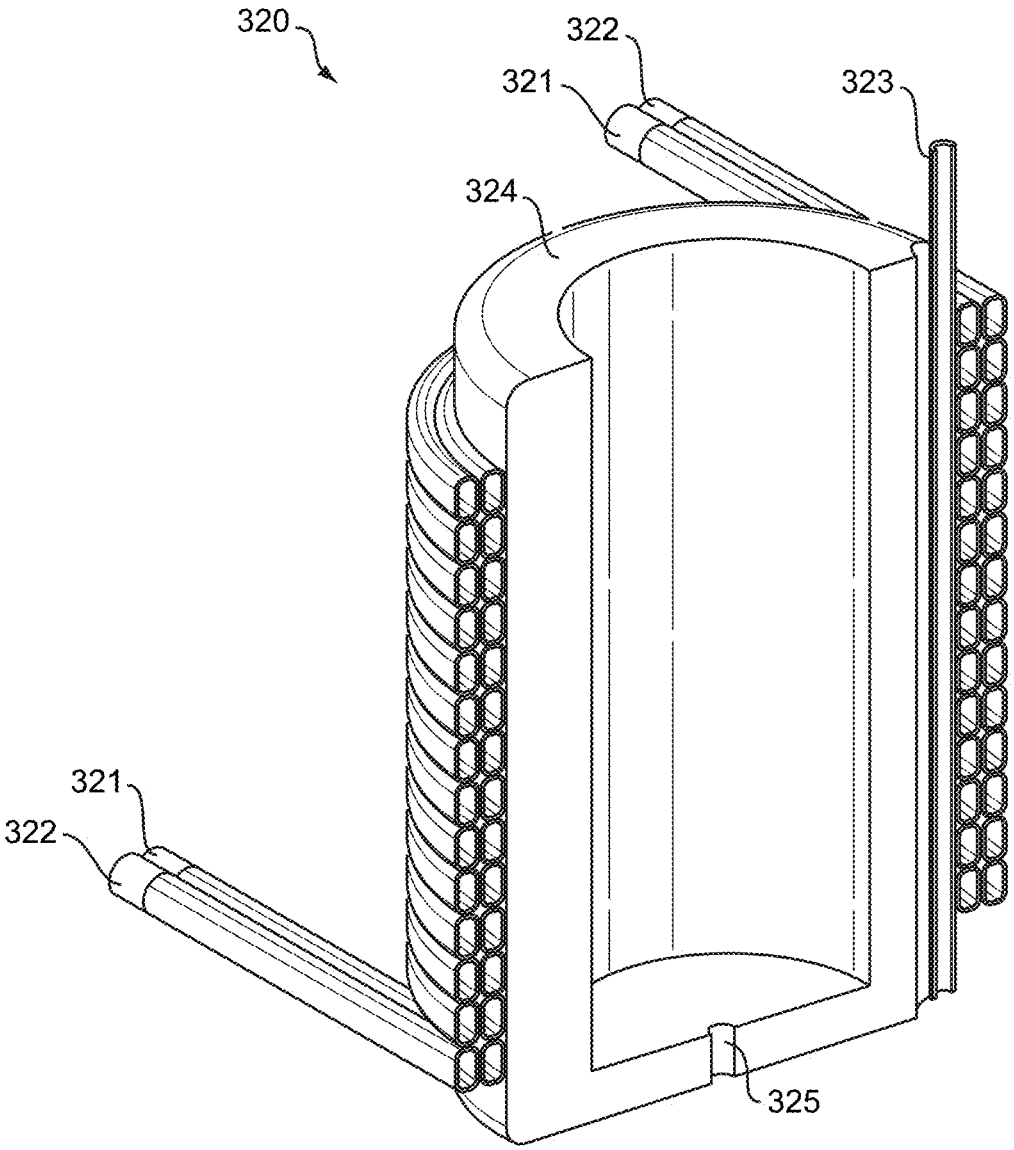
FIG. 3 depicts an example of a tankless evaporator in accordance with exemplary embodiments of the present disclosure.

FIG. 3 depicts a tankless evaporator 320 in accordance with exemplary embodiments of the present disclosure. Evaporator 320 includes two coils 321 and 322 for a to-be-cooled fluid (e.g., water) and a refrigerant, respectively. An optional capillary tube thermostat well 323 is shown. Evaporator 320 includes a drum 324 and the coils 321, 322 are wrapped around the drum 324. The coils 321 and 322 are preferably made of a high-thermal conductivity metal or alloy such as copper, etc. In preferred embodiments, coils 321 and 322 can be made of C10200, C12000, or C12200 copper alloy; other alloys may of course be used within the scope of the present disclosure. Evaporator 300 can be used, e.g., in refrigeration circuits, and in preferred embodiments can be used in water coolers.

The drum 324 provides a structure for the coils 321, 322 to be placed or wrapped around. The drum 324 also provides a significant thermal mass for cold thermal storage (effectively a thermal sink). As shown, the drum 324 is relatively thick compared to the tubing (e.g., the outer diameter or width) used for the coils 321, 322. The drum is preferably made of a thermally conductive material having a high volumetric specific heat, e.g., aluminum and/or others suitable metal(s) or metal alloy(s). In preferred embodiments, an aluminum 6060, 6061, or 6063 alloy is used for drum 324; other metals and/or alloys may of course be used within the scope of the present disclosure. In preferred embodiments, drum 324 may have a thickness of between one-quarter (0.25) inch to three (3) inches (in direction of its radius of curvature) or may have a thickness between one (1) and thirty (30) times that (e.g., the outer diameter or width) of one of the coils in a direction normal to the drum's longitudinal axis or center line. In exemplary embodiments, the drum is one (1) inch in thickness, 1.25 inches in thickness, 1.5 inches in thickness, or 1.75 inches in thickness; other thicknesses are within the scope of the present disclosure.

With continued reference to FIG. 3, in contrast with some prior art evaporators, the inner coil 321 is selected as the water coil, and the outer coil 322 is selected as the refrigerant coil. In operation, as the water in coil 321 is chilled by the refrigerant in coil 322, the drum 324 is also cooled. If the temperature of drum 324 is allowed, e.g., controlled, to drop below the temperature of the supply water in coil 321, drum 324 will serve to assist the refrigerant (in coil 322) in cooling the water coil 321. This presents an advantage over prior water coolers since the refrigeration system in typical prior art electric water coolers operate to cool at a rate which is less than the flow rate of water out of the system, i.e., those prior art systems cannot cool the incoming water as fast as the water enters and leaves the system.

As a result of the configuration of the coils and the cooling mass of drum 324, the drum 324 serves to improve the cooling rate afforded by the evaporator, e.g., during conditions of unsteady-state demand. The refrigerant being in the outside coil 322 also further assists heat transfer of the evaporator 320 because in operation the outer coil 322 will shrink more than the water 321 coil due to coil 321 being the colder of the two. This will press the coils more tightly together. Consequently evaporator 320 is able to remedy, ameliorate, or overcome many or all of the deficiencies noted previously for prior art designs.

Figure 4:
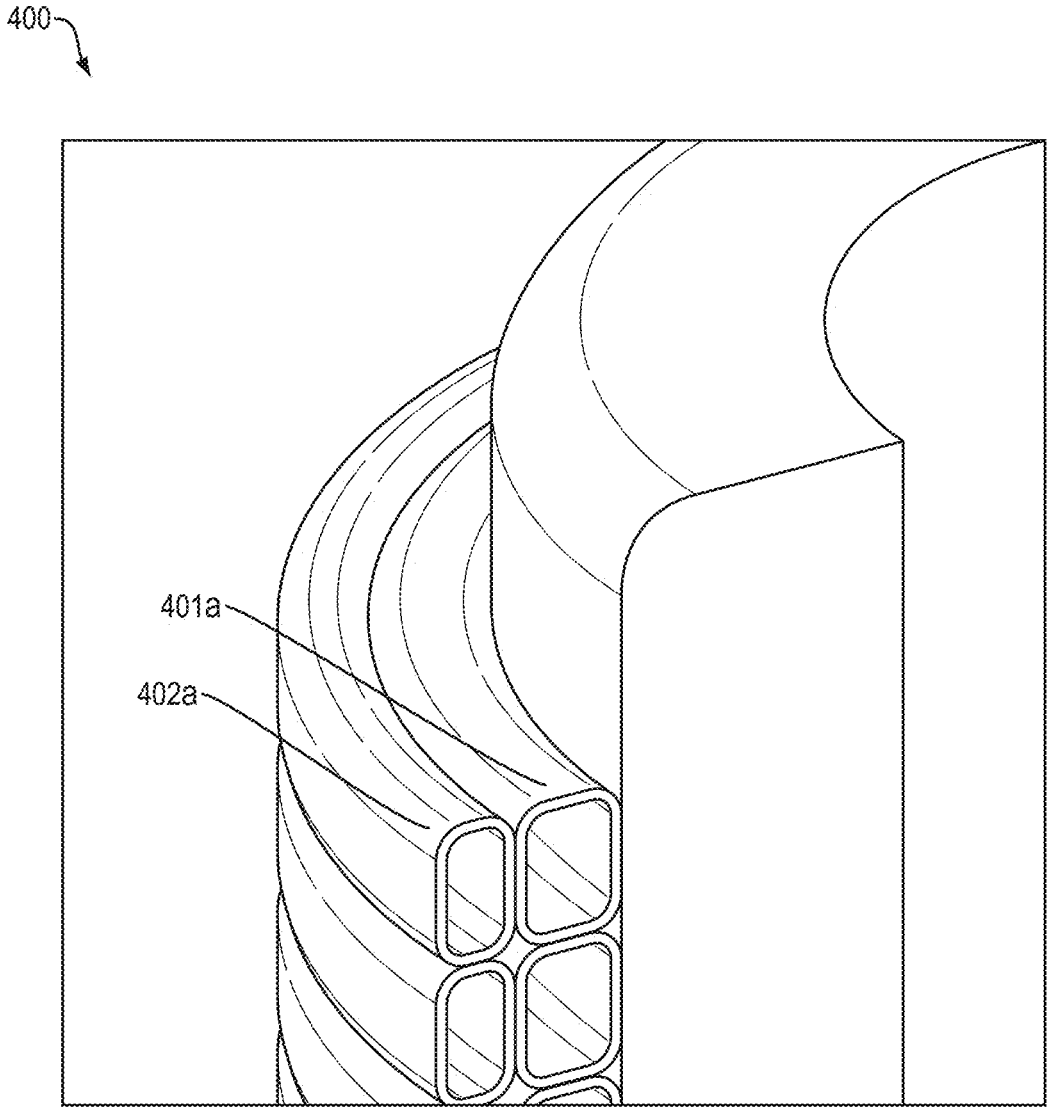
FIG. 4 depicts an alternate embodiment of a tankless evaporator in accordance with the present disclosure.

FIG. 4 shows an alternate embodiment 400 of an evaporator in accordance with the present disclosure. Inner and outer coils 401, 402 are configured in a coiled relationship with a drum 404 and in operation convey water and refrigerant, respectively. As shown, inner coil 401 can be made of larger tubing—having a greater cross-sectional area 401*a*—than the cross-sectional area 402*a* of the outer coil 402. In exemplary embodiments, the coils 401, 402 can be formed in such a way that their heights (direction parallel to the longitudinal axis of drum 404) are equal or nearly equal so that the coils have the same number of wraps (full or partial coil revolutions) around the drum 404. A configuration such as shown in FIG. 4 can provide for an increased volume of cooled water compared to prior art designs, e.g., approximately 40-50% more volume.

Figure 5:
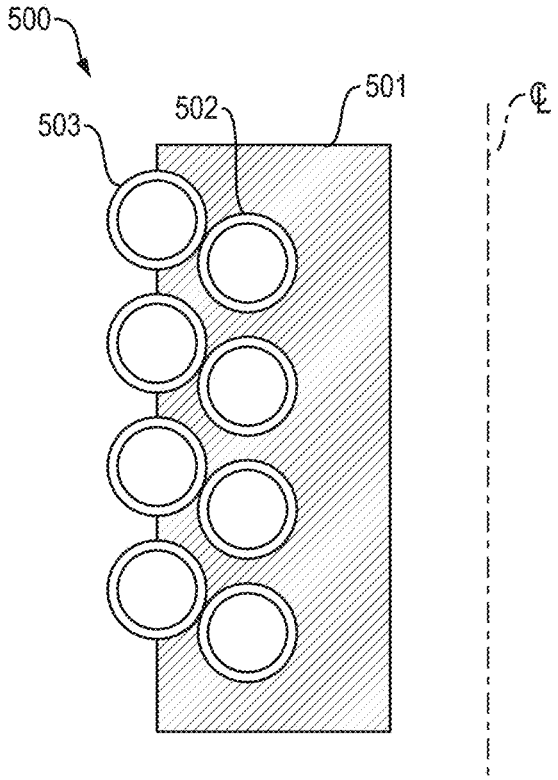
FIG. 5 depicts a further embodiment of a tankless evaporator in accordance with the present disclosure.

FIG. 5 depicts a further embodiment of a tankless evaporator 500 in accordance with the present disclosure. Evaporator 500 includes a drum 501 as well as inner and outer coils 502 and 503. The center line (longitudinal axis) of drum 501 is indicated. As shown, inner coil 502 is formed, e.g., cast, in the drum 503. The outer surface of the drum 501 can be configured to receive or hold the outer could 503; for example, the outer surface of the drum 501 can be machined or cast to have spiral grooves for holding the outer coil 503 when wrapped about the drum 501. Internally grooved/finned tubing may optionally be used for the refrigerant coil in the configuration shown.

Accordingly, it will be appreciated that embodiments of evaporators, refrigeration circuits, and water coolers in accordance with the present disclosure can offer numerous advantages and benefits relative to prior art designs.

The components, materials, steps, features, objects, benefits, and advantages that have been discussed are merely illustrative. None of them, nor the discussions relating to them, are intended to limit the scope of protection in any way. Numerous other embodiments are also contemplated. These include embodiments that have fewer, additional, and/or different components, materials, steps, features, objects, benefits, and/or advantages. These also include embodiments in which the components, materials, and/or steps are arranged and/or ordered differently.

For example, the drum can be anodized to facilitate reduction or elimination of galvanic corrosion between different metals or metal alloys, e.g., between aluminum of a drum when in contact with copper of a coil. Sensor locations (such as for one or more types of temperature sensors) can be added in addition to or substitution for the capillary tube thermostat well, when present. Additional wraps (coils) of the tubes (conduits) can be added. The inner coil shape can be modified, and/or the drum outer surface can be shaped so as to conform or better conform to the surface of the inner coil. The control system could be set up so that the refrigeration system is turned on after a certain amount of demand time has been incurred, e.g., the water cooler or "bubbler" has been operated for a specified amount of time, e.g., 15 seconds, etc. This latter feature can be used to improve performance because cooling of the water can begin at a specified time without having to wait for the capillary tube thermostat to trigger cooling.

Further, the outer coil shape and/or inner coil shape could be modified to conform better to each other. The refrigerant and water coils can be switched so that the refrigerant coil is on the inside. In some embodiments, a stainless steel coil could be cast into the material of the drum, e.g., aluminum, and the water could be run through both the copper and stainless steel tubes; any other suitable corrosion-resistant material could be used in place of stainless steel. As noted previously, the inner coil can be made of larger tubing (or conduit) than the outer coil. For example, the inner coil may be formed to have a geometry with a greater depth (or width)—e.g., referring to the extent of the coil in a radial direction relative to the longitudinal axis of an adjacent drum—than an adjacent outer coil but with the same height as the outer coil, such that their heights (and therefore number of wraps about an adjacent drum) are still consistent. In other embodiments, the coils may instead made of tubing or conduit with different heights (relative to the drum and its center line or longitudinal axis). Internally grooved/finned tubing can be used for a refrigerant coil. Further, the structures described (coils and/or drum) may each be made from composite or multiple-components materials, within the scope of the present disclosure. For example, a drum may have aluminum and copper portions, copper and stainless steel portions, aluminum and stainless steel portions, etc. Other materials may be used stead of or in addition to those that have been described. Further, a tankless evaporator can be used in either a closed refrigeration circuit or an open one.

Moreover, while refrigerant and water tubing have been described herein and shown in the drawings in the context of surrounding the drums in circular spirals, any other suitable geometries can be used for configuring the tubing relative to a drum. For non-limiting example, the water and/or refrigerant tubing may be configured in rectilinear patterns over the surface of a drum. Furthermore, the configuration of one type of coil (or tubing) can be different than that of another type, and two or more coils can be used for each type of coil instead of a single coil as provided in the description above. For example, in some embodiments, a water coil can be wound in a circular spiral around a drum, while the refrigerant coil can be configured around the drum and/or water coil in a rectilinear, e.g., space-filling, configuration. Moreover, each type of coil may have multiple different configurations. For example, a refrigerant coil may have a circular spiral configuration that extends over a water coil to areas on a drum above and below the area on the drum's outer surface that is covered by the water coil; above and below the water coil, the refrigerant coil may have one "pitch," or two different pitches, respectively, which is/are different than a pitch used for the section of coil covering the water coil. Separate coils may be used respectively for each separate section but that is not required.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element proceeded by an "a" or an "an" does not, without further constraints, preclude the existence of additional elements of the identical type. The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

What is claimed is:

1. An evaporator for use in a fluid chiller, the evaporator comprising:

a drum of heat conductive material defining a thermal mass;

a water coil disposed adjacent around the drum; and an evaporator coil configured around the drum and adjacent to the water coil, wherein the evaporator coil is operative to cool the water coil;

wherein the drum has a cylindrical body with an inner radius of curvature and an outer radius of curvature, wherein the difference between the outer and inner radii of curvature defines a thickness, and wherein the thickness is between one and thirty times a thickness of the water coil or of the evaporator coil in a direction normal to a longitudinal axis of the cylindrical body.

2. The evaporator of claim 1, wherein the drum comprises aluminum.

3. The evaporator of claim 1, wherein the drum comprises an aluminum alloy.

4. The evaporator of claim 3, wherein the aluminum alloy comprises 6060, 6061, or 6063 aluminum alloy.

5. The evaporator of claim 1, wherein the water coil or evaporator coil comprise C10200, C12000, or C12200 copper alloy.

6. A water cooler for dispensing cooled water, the water cooler comprising:

a housing configured to receive water from a water supply;

a refrigeration circuit for cooling water supplied by the water supply;

wherein the refrigeration circuit includes an evaporator including, (i) a drum of heat conductive material defining a thermal mass;

(ii) a water coil disposed adjacent around the drum;

(iii) an evaporator coil configured around the drum and adjacent to the water coil, wherein the evaporator coil is operative to cool the water coil; and a cold-water valve configured to dispense cooled water received from the evaporator;

wherein the drum has a cylindrical body with an inner radius of curvature and an outer radius of curvature, wherein the difference between the outer and inner radii of curvature defines a thickness, and wherein the thickness is between one and thirty times a thickness of the water coil or of the evaporator coil in a direction normal to a longitudinal axis of the cylindrical body.

7. The water cooler of claim 6, further comprising a heating element and hot-water valve configured to dispense hot water.

8. The water cooler of claim 6, further comprising a refrigeration circuit configured to supply the evaporator with refrigerant.

9. The water cooler of claim 8, further comprising a controller operative to control operation of the refrigeration circuit.

10. A refrigeration circuit for cooling a fluid, the circuit comprising:

a compressor operative to compress a refrigerant in a conduit;

a condenser;

a throttling device and an evaporator, wherein the evaporator includes, (iv) a drum of heat conductive material defining a thermal mass;

(v) a water coil disposed adjacent around the drum;

(vi) an evaporator coil configured around the drum and adjacent to the water coil, wherein the evaporator coil is operative to cool the water coil; and wherein the drum has a cylindrical body with an inner radius of curvature and an outer radius of curvature, wherein the difference between the outer and inner radii of curvature defines a thickness, and wherein the thickness is between one and thirty times a thickness of the water coil or of the evaporator coil in a direction normal to a longitudinal axis of the cylindrical body.

* * * * *